US009094763B2

(12) United States Patent
Pellisari

(10) Patent No.: US 9,094,763 B2
(45) Date of Patent: Jul. 28, 2015

(54) PORTED SPEAKER AND CIRCUIT BOARD

(71) Applicant: Pellisari, LLC, Encinitas, CA (US)

(72) Inventor: Francesco Pellisari, Rome (IT)

( * ) Notice: Subject to any disclaimer, the term of this patent is extended or adjusted under 35 U.S.C. 154(b) by 0 days.

(21) Appl. No.: 14/178,894

(22) Filed: Feb. 12, 2014

(65) Prior Publication Data

US 2014/0226845 A1 Aug. 14, 2014

Related U.S. Application Data

(60) Provisional application No. 61/764,251, filed on Feb. 13, 2013.

(51) Int. Cl.
*H04R 1/20* (2006.01)
*H04R 1/28* (2006.01)

(52) U.S. Cl.
CPC ..... *H04R 1/2826* (2013.01); *H04R 2420/07* (2013.01)

(58) Field of Classification Search
CPC ..... H04R 1/2819; H04R 2499/11; H04R 1/2826; H04R 1/2834
USPC ..... 381/345, 349, 351–353; 181/199
See application file for complete search history.

(56) References Cited

U.S. PATENT DOCUMENTS

| | | | | |
|---|---|---|---|---|
| 5,097,513 | A | 3/1992 | Jordan et al. | |
| 6,944,024 | B1 * | 9/2005 | Devine, III | 361/704 |
| 7,870,928 | B1 * | 1/2011 | Jiang et al. | 181/148 |
| 2011/0206228 | A1 | 8/2011 | Shiozawa et al. | |

FOREIGN PATENT DOCUMENTS

| | | |
|---|---|---|
| JP | 2007329829 | 12/2007 |

* cited by examiner

*Primary Examiner* — Rasha Al Aubaidi
(74) *Attorney, Agent, or Firm* — Fish & Tsang LLP

(57) ABSTRACT

The inventive subject matter provides a reflex tube or port that includes a circuit board and a speaker enclosure that incorporates such a reflex tube. The circuit board is mounted about the reflex tube and can be configured so as to form a resonance chamber with an interior wall of a speaker enclosure to form a resonance chamber. Such a reflex tube can also include one or more connections.

12 Claims, 6 Drawing Sheets

PORTED SPEAKER AND CIRCUIT BOARD

This application claims priority to United States Provisional Application No. 61/764251 filed on Feb. 13, 2013. These and all other referenced extrinsic materials are incorporated herein by reference in their entirety. Where a definition or use of a term in a reference that is incorporated by reference is inconsistent or contrary to the definition of that term provided herein, the definition of that term provided herein is deemed to be controlling.

FIELD OF THE INVENTION

The field of the invention is audio speakers, in particular bass reflex speakers

BACKGROUND

A speaker enclosure is a cabinet or enclosure that houses one or more speaker drivers and associated electronics, such as crossover circuits and amplifiers. Such electronics are generally provided on a printed circuit board, which is mounted on an interior wall of the speaker enclosure. Although generally configured as rectangular enclosures, speaker enclosures are also available in a wide variety of shapes. Such shapes include spheres, ovoids, tear-drop shapes, or any one of a wide variety of curved or curvilinear configurations as suits the functional and esthetic needs of the designer. Speaker enclosures can also incorporate internal baffles, reflex ports or tubes, and acoustic insulation in order to improve acoustic performance.

In order to provide free movement of the speaker driver, many speaker enclosures (particularly those intended for the reproduction of low frequencies) include one or more reflex ports or tubes. These provide openings through the wall of the speaker enclosure allow for pressure equalization between the interior and exterior of the speaker enclosure when the speaker driver is active, thereby allowing the diaphragm of the speaker driver to move freely. In addition, such reflex ports or tubes can be configured and positioned to provide a resonance chamber (such as, for example, a Helmholtz resonance chamber) within the speaker enclosure. Such resonance chambers can be designed to transmit sound that is generated towards the back of the speaker enclosure forward, towards the listener. They can also be designed enhance certain frequency ranges and thereby improve the reproduction of low frequencies within small speaker enclosures. Achieving optimal performance of such resonance chambers is a complex task, which is rendered even more difficult when spherical, curved, or curvilinear speaker enclosures are utilized.

A potential source of distortion in the audible signal generated by a speaker enclosure is the printed circuit board. As noted above, such printed circuit boards are generally attached to an interior wall of the speaker enclosure. This is usually accomplished using screws that affix the printed circuit board to a planar interior wall of the speaker enclosure. In such a position, however, the printed circuit board can be an additional source of acoustic vibration, particularly over time as vibrations of the walls of the speaker enclosure during use loosen the screws used for fixing the circuit board. In addition, such an approach is not well suited to speaker enclosures that do not include a significant planar aspect, such as spherical and ovoidal enclosures, and as such do not present planar surfaces suitable for printed circuit board attachment.

Attempts have been made to address such issues. For example U.S. Pat. No. 5,097,513 to Jordan et al. (filed Apr. 31, 1990) describes a nontraditional speaker enclosure that includes a cylindrical housing which incorporates a speaker driver and a printed circuit board, and is turn connected via an opening to a cylindrical reflex tube that runs parallel to the cylindrical housing. Such a speaker enclosure, however, relies on affixing the printed circuit board to a wall of the enclosure, where it remains subject to intense vibration. In addition, such an approach does not accommodate curved or curvilinear speaker enclosure designs.

Attempts have also been made to address the issue of resonance chamber optimization within a speaker enclosure. For example, U.S. Patent Application 2011/0206228 to Shiozawa et al. (filed Feb. 24, 2011) describes the use of a reflex tube that can be moved to different positions relative to the speaker driver in order to modify the performance of a resonance chamber within a speaker enclosure. However, since the process of generating an optimal resonance chamber is a result of complex interactions between the components of the speaker enclosure, their relative positions, and their relative dimensions it is unclear if such a device can be successfully utilized in curved or curvilinear speaker enclosures, in which both the position and angle of the reflex tube or port relative to the speaker driver would be altered by such movement.

These and all other extrinsic materials discussed herein are incorporated by reference in their entirety. Where a definition or use of a term in an incorporated reference is inconsistent or contrary to the definition of that term provided herein, the definition of that term provided herein applies and the definition of that term in the reference does not apply.

Thus, there is still a need for an audio speaker that incorporates a simple and reliable positioning of a printed circuit board within the speaker enclosure, in particular one that supports the use of curved and/or curvilinear speaker enclosure shapes and/or the generation of a resonance chamber within the speaker enclosure.

SUMMARY OF THE INVENTION

The inventive subject matter provides apparatus, systems and methods in which a printed circuit board is secured within a speaker enclosure, by affixing the printed circuit board about a reflex tube. The printed circuit board and the associated reflex tube can be configured so as to form a resonance chamber, such as a Helmholtz resonance chamber, with an interior wall of a speaker enclosure. Such speaker enclosures can be spherical, ovoid, teardrop shaped, or of any suitable curved and/or curvilinear configuration.

Unless the context dictates the contrary, all ranges set forth herein should be interpreted as being inclusive of their endpoints, and open-ended ranges should be interpreted to include commercially practical values. Similarly, all lists of values should be considered as inclusive of intermediate values unless the context indicates the contrary In one embodiment of the inventive concept, a speaker enclosure includes a reflex tube or port and a circuit board that is affixed or otherwise disposed about or around the reflex tube. Such a reflex tube can have one or more openings, and the circuit board can be affixed or otherwise disposed within about 1 cm of such an opening. Such a circuit board can include circuitry and/or antennary structures suitable for reception and/or processing of wireless signals. Alternatively, such antennary structures can be incorporated into or lie within the reflex tube. In some embodiments of the inventive concept an audio signal and/or an audio signal connection can pass through this reflex tube. Similarly, the speaker enclosure can include a connection support. In some embodiments of the inventive concept such a connection support can be configured to reduce air turbulence within the reflex tube.

In other embodiments of the inventive concept, such a speaker enclosure can include a wall. In such an embodiment the wall and the circuit board can be configured and/or positioned to generate a resonance chamber. In some embodiments of the inventive concept such a resonance chamber is a Helmholtz resonance chamber. Similarly, a speaker enclosure of the inventive concept can include an outer wall. Such an outer wall can have an approximately spherical or an approximately ovoid configuration.

Various objects, features, aspects and advantages of the inventive subject matter will become more apparent from the following detailed description of preferred embodiments, along with the accompanying drawing figures in which like numerals represent like components.

BRIEF DESCRIPTION OF THE DRAWINGS

FIG. 1A shows a lateral view of a reflex tube with a mounted circuit board with associated electronic components. FIG. 1B shows a view along the major axis of a reflex tube with a mounted circuit board.

FIG. 2A shows a lateral view of a reflex tube having a mounted circuit board with associated electronic components and a connection support that carries at least one connection. FIG. 2B shows a view along the major axis of a reflex tube having a mounted circuit board with associated electronic components and a connection support that carries a plurality of connections.

FIG. 3A shows a speaker enclosure with a reflex tube that has a mounted circuit board. FIG. 3B shows a speaker enclosure with a reflex tube that has a mounted circuit board and a connection support.

DETAILED DESCRIPTION

Figure 1A:
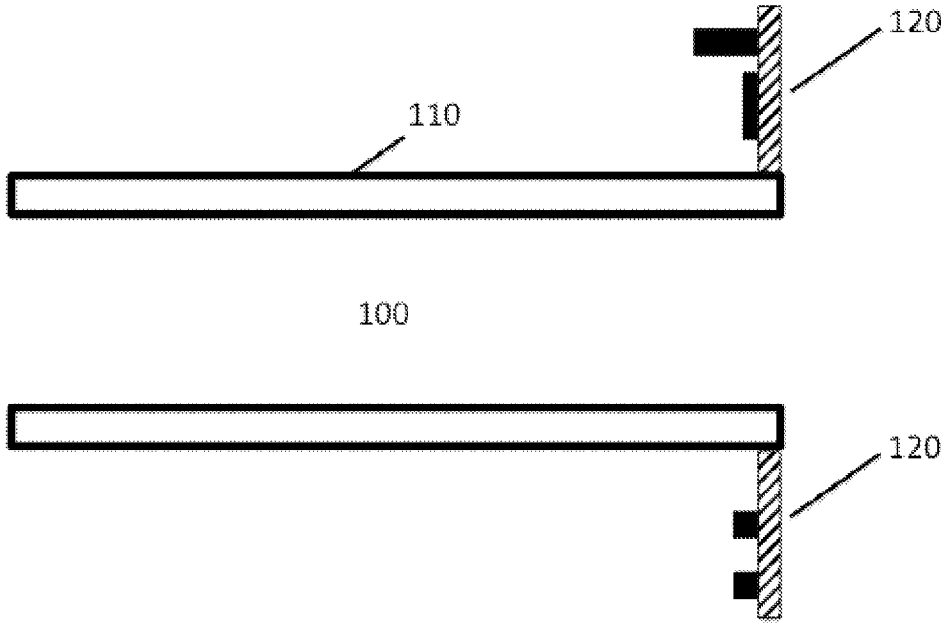
FIGS. 1A and 1B depict an embodiment of a reflex tube of the inventive concept.

It should be noted that while the following description is drawn to a reflex tube and a speaker enclosure with a reflex tube, various alternative configurations are also deemed suitable and can employ various auditory devices including ultrasonic emitters, infrasound emitters, ultrasonic mixers, diagnostic ultrasound devices, emitters for sonar apparatus, and other sound-based devices, individually or collectively. One should appreciate that embodiments of the inventive concept can operate as discrete units or can be integrated into devices such as, for example, media players, external sound systems for media players (either directly or wirelessly connected), televisions, handheld and/or console gaming systems, telephones, and personal computing devices.

One should appreciate that the disclosed devices and techniques provide many advantageous technical effects including: reducing undesirable noise resulting from the unwanted vibration of circuit boards associated with speaker systems, ease of mounting of circuit boards in curved or curvilinear speaker enclosures that do not present adequate flat internal surfaces, provision of a mechanism for forming a resonant chamber within a speaker enclosure, and positioning of a circuit board of a speaker enclosure for efficient cooling via sound generated air movement.

The following discussion provides many example embodiments of the inventive subject matter. Although each embodiment represents a single combination of inventive elements, the inventive subject matter is considered to include all possible combinations of the disclosed elements. Thus if one embodiment comprises elements A, B, and C, and a second embodiment comprises elements B and D, then the inventive subject matter is also considered to include other remaining combinations of A, B, C, or D, even if not explicitly disclosed.

The inventive subject matter provides apparatus, systems and methods in which one can conveniently and securely mount a printed circuit board in a speaker enclosure via affixing the circuit board about a reflex port or tube. In some embodiments of the inventive concept the printed circuit board (or circuit board) can be secured to the reflex tube at or near one of its open ends; in other embodiments of the inventive concept the circuit board can be secured about an opening of the reflex tube that is positioned in the interior of the speaker enclosure. This advantageously provides a secure attachment point for the circuit board that is not associated with the walls of the speaker enclosure, which are subject to vibration generated by a speaker driver that is mounted to them. Such vibration can damage a circuit board affixed to such a wall, and can generate unwanted interfering sound through vibration of the planar circuit board surface. Additional benefits of the inventive concept are realized in curved and/or curvilinear speaker enclosures, which can lack planar walls that are suitable for mounting circuit boards. Such speaker enclosures can be, for example, spherical or approximately spherical, ovoid or approximately ovoid, tear drop shaped, or any suitable configuration that can be represented by rotation or extension of a curve or arc.

Circuit boards of the inventive concept can include one or more hole(s), opening(s), or aperture(s) that permit the reflex tube to pass through at least a portion of a circuit board associated with a speaker. In such embodiments an aperture or hole of the circuit board can at least approximate the cross section of such a reflex tube. Alternatively, a circuit board can be affixed to a reflex tube by one or more edges of the circuit board without surrounding the reflex tube. Similarly, a circuit board of the inventive concept can be composed of a plurality of segments or portions, where the segments and/or portions are affixed or otherwise mounted about the reflex tube. A circuit board of the inventive concept can be affixed to the reflex tube by any suitable means, including, but not limited to, screws, rivets, adhesives, friction, and/or threaded fittings. In preferred embodiments of the inventive concept the circuit board can be mounted approximately perpendicular to a major axis of the reflex tube, however the inventors contemplate that other angles of attachment can also be suitable.

A reflex tube of the inventive concept can be constructed of any suitable material with sufficient stiffness. Suitable materials include, paper (which can be reinforced), cardboard, textiles, wood, laminates, resin, fiberglass, carbon fiber, plastic, metal, ceramic, or combinations of these. In some embodiments of the inventive concept the reflex tube (or a portion thereof) can act as a heat sink for the circuit board, advantageously utilizing air movement through the reflex tube to remove heat from the circuit board and/or circuit board components. In such embodiments the reflex tube can be constructed of a heat conductive material, for example aluminum, copper, stainless steel, metalized plastics, graphite, or combinations of these. It should be appreciated that air movement through such a reflex tube as part of its normal function facilitates use of the reflex tube as a heat sink or heat transfer device.

In an alternative embodiment of the inventive concept, a circuit board can be affixed within the lumen of a reflex tube, thereby permitting easy access by a user. In such embodiments the circuit board can include one or more connections, for example a power connection, and audio signal connection, and/or a data connection (such as a USB port). Similarly, a reflex tube of the inventive concept can include an antennary structure suitable for sending and receiving wireless signals suitable for transfer of audio information.

In still other embodiments of the inventive concept a circuit board affixed within the lumen of a reflex tube can be configured to reduce air turbulence within the reflex tube. This advantageously reduces undesirable noise resulting from movement of air through the reflex tube during normal use, and eases design constraints on a speaker incorporating such a reflex tube.

Figure 1B:
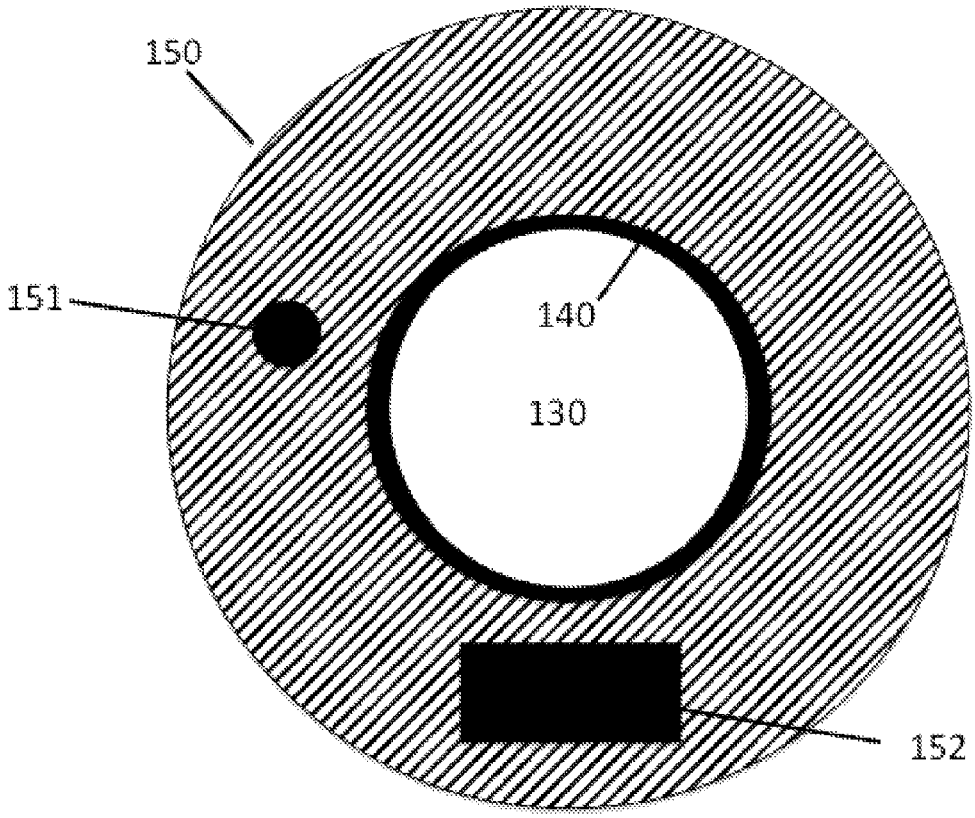

An example of a reflex tube of the inventive concept is shown in FIGS. 1A and 1B. In FIG. 1A, a reflex tube 100 with a wall 110 is shown with a circuit board 120 affixed about an opening of the reflex tube 100. Such a reflex tube can have an approximately circular cross section, however embodiments of the inventive concept in which a reflex tube has an elliptical, polygonal, and/or irregular cross section are also contemplated. In some embodiments of the inventive concept the geometry of a reflex tube can vary along one or more of its axes. Similarly, a reflex tube of the inventive concept can include one or more bends or arcs along its length. The circuit board 120 is shown with several electronic components. The inventors contemplate that such a configuration necessarily directs air movement over or near electronic components of the circuit board 120 as air moves through the reflex tube 100 during normal operation of the speaker assembly, advantageously removing heat from and thereby cooling such electronic components. This effect can be enhanced by construction of the wall 110 of a heat conducting material, at least in part, thereby allowing the reflex tube 100 to act as a heat sink for the circuit board 120. FIG. 1B presents a view along the major axis of a reflex tube of the inventive concept, showing a reflex tube 130 with a wall 140 and circuit board 150 that includes electronic components (151, 152). The reflex tube 130 occupies an aperture or opening of the circuit board 150. Such a mounting arrangement for a circuit board is, advantageously, independent of the shape of the speaker enclosure and provides simple and efficient attachment of a circuit board within a speaker enclosure of any configuration. This can be particularly advantageous for spherical, ovoid, curved, and curvilinear speaker enclosures (and speaker enclosures that include portions with such geometries). In addition, when mounted in this fashion the circuit board is at least partially isolated from vibration of the interior walls of the speaker enclosure, thereby reducing the possibility of vibrational damage to susceptible circuit board components and the generation of unwanted sounds via vibration of the planar circuit board.

Although depicted as being affixed at a terminal opening of a reflex tube, a circuit board of the inventive concept can be attached at any position along the reflex tube's length. In some embodiments of the inventive concept the circuit board can be affixed within about 25 cm of an opening of a reflex tube. In other embodiments of the inventive concept the circuit board can be affixed within about 10 cm of an opening of a reflex tube. In still other embodiments of the inventive concept the circuit board can be affixed within about 1 cm of an opening of a reflex tube.

In another embodiment of the inventive concept, a reflex tube can include a circuit board and one or more connections. Such connections include, but are not limited to audio signal connections, power connections, and data connections (such as, for example, a USB connector and/or a dock connector). Association of such connections with a reflex tubes advantageously simplifies manufacture of curved or curvilinear speaker enclosures by removing the need to accurately drill or mold access holes through curved surfaces. Such placement also eliminates negative acoustic affects associated with the placement of holes through the walls of a speaker enclosure. Such a connection or connections can be affixed to a wall of the reflex tube. Alternatively, such a connection or connections can be affixed to a connection support, which can in turn affixed to the reflex tube. In some embodiments of the inventive concept such a connection support can be affixed within the lumen of the reflex tube. In still other embodiments of the inventive concept, a connection support can be configured to reduce air turbulence within a reflex tube.

Figure 2A:
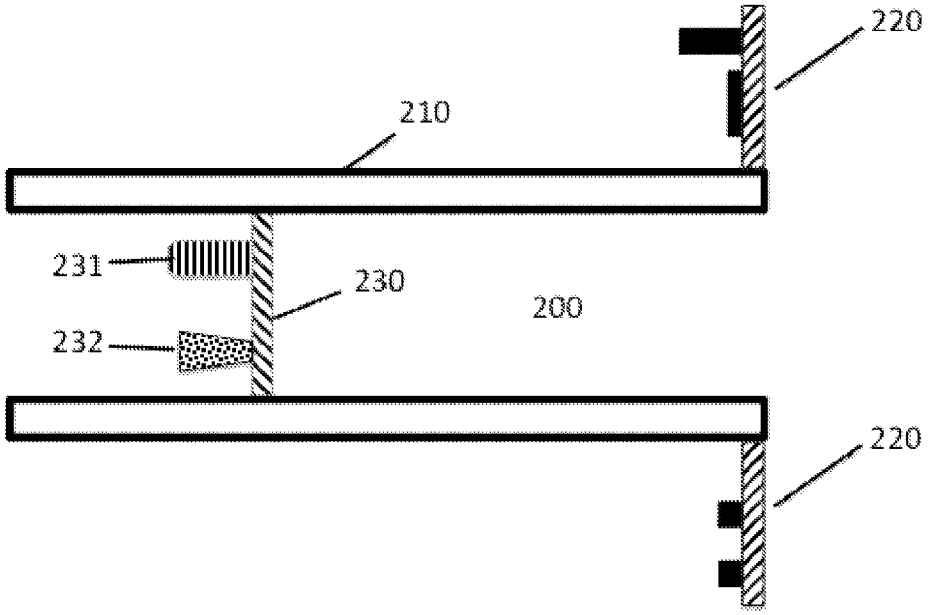
FIGS. 2A and 2B depict another reflex tube of the inventive concept.
Figure 2B:
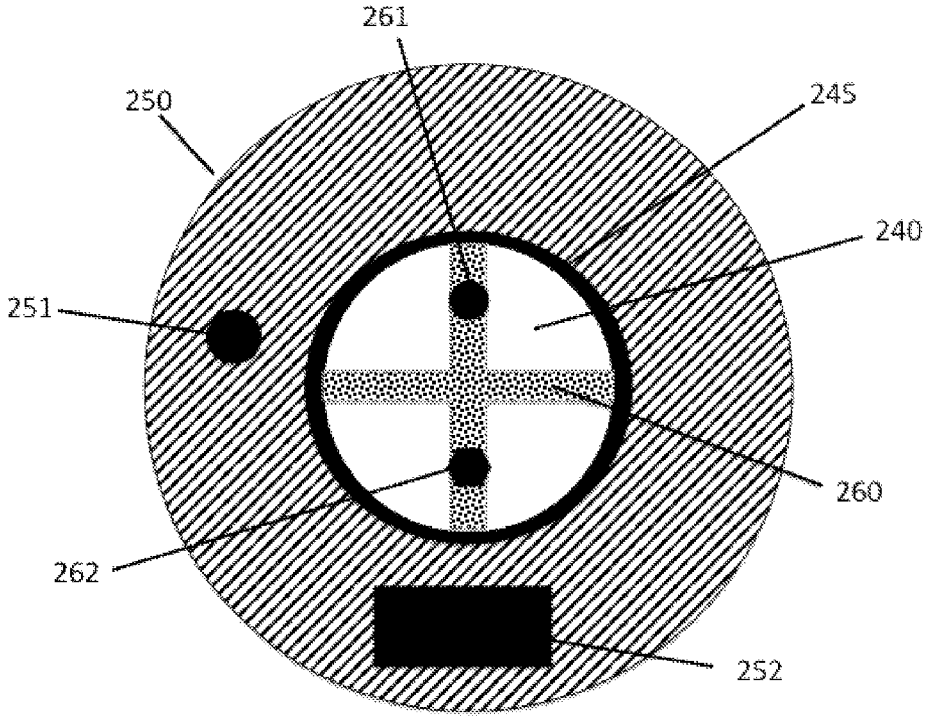

An example of such an embodiment is shown in FIGS. 2A and 2B, which show a cross sectional view and a front view of a reflex tube and circuit board of the inventive concept, respectively. As depicted in FIGS. 2A and 2B, a reflex tube 200 with a wall 210 includes a circuit board 220 that has associated electronic components. In this example the circuit board 220 is affixed near a terminal opening of the reflex tube 200 through contact of the wall 210 with an opening in the circuit board 220. The reflex tube 200 also includes connections (231, 232) that are mounted or affixed to a connection support 230, which is in turn affixed within the lumen of the reflex tube 200. FIG. 2B shows a view along the major axis of a reflex tube of a similar embodiment of the inventive concept. A reflex tube 240 includes a circuit board 250 that is affixed to a wall 245 of the reflex tube 240. The circuit board 250 includes electronic components (251, 252). The reflex tube 240 also includes a connection support 260 that is affixed within the lumen of the reflex tube 240. A plurality of connections (261, 262) is shown affixed to the connection support 260, although it should be appreciated that a single connection can be utilized.

In some embodiments of the inventive concept a circuit board associated with a reflex tube can be utilized in combination with one or more walls of a speaker enclosure to form a resonant chamber within the speaker enclosure. Such a resonant chamber can be, for example, a Helmholtz resonance chamber. Such resonant chambers can be used to enhance speaker performance within certain frequency ranges. For example, a resonance chamber in a small speaker that is tuned to resonate at low frequencies can enhance the low frequency performance of the small speaker. Such embodiments can be of particular advantage in spherical (or approximately spherical) and/or ovoid (or approximately ovoid) speaker enclosures.

Figure 3A:
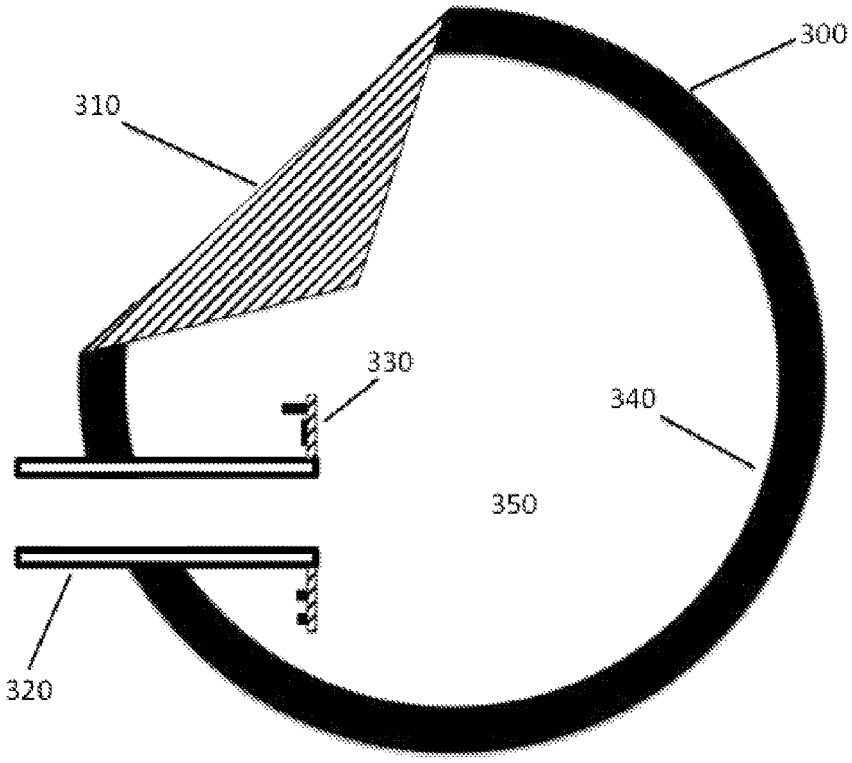
FIGS. 3A and 3B depict speaker enclosures of the inventive concept.
Figure 3B:
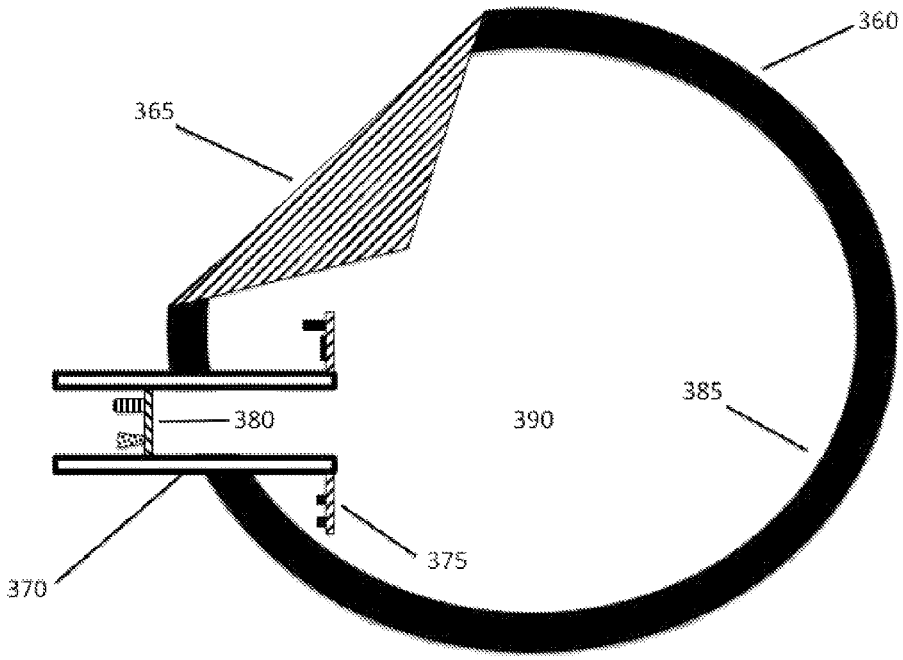

Exemplary speaker enclosures of the inventive concept are illustrated in FIGS. 3A and 3B. FIG. 3A shows an approximately spherical speaker enclosure 300 that includes a speaker driver 310 and a reflex tube 320 (which is similar to the reflex tube of FIG. 1). The outer housing of the speaker enclosure 300 is approximately spherical. The reflex tube 320 includes a circuit board 330 that features electronic components. Such electronic components can include circuitry and/or an antenna suitable for reception of wireless signals. The circuit board 330 is positioned and dimensioned such that interactions with a wall 340 of the speaker enclosure 300 form a resonant cavity 350 within the speaker enclosure 300 that enhances acoustic performance of the system. A similar embodiment of the inventive concept is shown in FIG. 3B. FIG. 3B shows an approximately spherical speaker enclosure 360 that includes a speaker driver 365 and a reflex tube 370 (which is similar to the reflex tube of FIG. 2). The outer housing of the speaker enclosure 360 is approximately ovoid. The reflex tube 370 includes a circuit board 375 that features electronic components. The circuit board 375 is positioned and dimensioned such that interactions with a wall 385 of the speaker enclosure 360 form a resonant cavity 390 within the speaker enclosure 360 that enhances acoustic performance of the system. The reflex tube 370 also includes a connection support 380 that features at least one connection, which simplifies construction of the speaker enclosure and improves audio performance by avoiding the need to drill and/or mold holes through the wall of the speaker enclosure 360.

As used herein, and unless the context dictates otherwise, the term "coupled to" is intended to include both direct coupling (in which two elements that are coupled to each other contact each other) and indirect coupling (in which at least one additional element is located between the two elements). Therefore, the terms "coupled to" and "coupled with" are used synonymously.

It should be apparent to those skilled in the art that many more modifications besides those already described are possible without departing from the inventive concepts herein. The inventive subject matter, therefore, is not to be restricted except in the scope of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps can be present, or utilized, or combined with other elements, components, or steps that are not expressly referenced. Where the specification claims refers to at least one of something selected from the group consisting of A, B, C . . . and N, the text should be interpreted as requiring only one element from the group, not A plus N, or B plus N, etc.

What is claimed is:

1. A speaker enclosure comprising:

a circuit board coupled to a housing; and a reflex tube extending through a hole in the circuit board such that the circuit board is disposed about the reflex tube, wherein each of the circuit board and the reflex tube are configured and positioned within the speaker enclosure to provide a resonance chamber with an interior wall of the speaker enclosure.

2. The speaker enclosure of claim 1, wherein the reflex tube has an opening, and at least some portion of the circuit board is disposed within 1 cm of at least some portion of the opening.

3. The speaker enclosure of claim 1, further comprising a connection support disposed within a lumen of the reflex tube, and configured to reduce air turbulence within the reflex tube.

4. The speaker enclosure of claim 1, further comprising at least one of (a) audio signal connection, (b) a power connections, and (c) a data connection disposed in a lumen of the reflex tube.

5. The speaker enclosure of claim 1, wherein the resonance chamber is a Helmholtz resonance chamber.

6. The speaker enclosure of claim 1, wherein the housing has an approximately spherical configuration.

7. The speaker enclosure of claim 1, wherein the housing has an approximately ovoid configuration.

8. An assembly for use in a speaker enclosure, comprising a reflex tube having a lumen, and a circuit board having an opening contiguous with the lumen, such that at least a portion of the circuit board is disposed about a perimeter of the reflex tube, and wherein each of the circuit board and the reflex tube are configured and positioned within the speaker enclosure to provide a resonance chamber with an interior wall of the speaker enclosure.

9. The reflex tube assembly of claim 8, wherein the an end of the reflex tube terminates in a position sufficiently close to the circuit board that air movement through the reflex tube cools the circuit board.

10. The reflex tube assembly of claim 8, further comprising at least one of an audio line, a power line and a data line disposed within the lumen.

11. The reflex tube assembly of claim 8, wherein the circuit board further comprises an antennary structure.

12. The speaker enclosure of claim 1, in which the circuit board is substantially circular.

* * * * *